US008460015B2

(12) United States Patent
Deno et al.

(10) Patent No.: US 8,460,015 B2
(45) Date of Patent: Jun. 11, 2013

(54) FIXING STRUCTURE OF SHIELD ELECTRIC WIRE AND FIXING METHOD FOR SHIELD ELECTRIC WIRE

(75) Inventors: Masahiro Deno, Makinohara (JP); Yoshitaka Tsushima, Makinohara (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 13/318,207

(22) PCT Filed: May 13, 2010

(86) PCT No.: PCT/JP2010/058481

§ 371 (c)(1),
(2), (4) Date: Oct. 31, 2011

(87) PCT Pub. No.: WO2010/131772

PCT Pub. Date: Nov. 18, 2010

(65) Prior Publication Data

US 2012/0058674 A1 Mar. 8, 2012

(30) Foreign Application Priority Data

May 13, 2009 (JP) ..... 2009-116537

(51) Int. Cl.
*H01R 13/648* (2006.01)

(52) U.S. Cl.
USPC ..... 439/98; 174/78

(58) Field of Classification Search
USPC ..... 174/74 R, 78, 75 C, 88 C; 439/98, 439/99
See application file for complete search history.

(56) References Cited

U.S. PATENT DOCUMENTS

| | | | | | |
|---|---|---|---|---|---|
| 4,896,000 | A | * | 1/1990 | Procter et al. | 174/74 R |
| 5,589,663 | A | * | 12/1996 | Wales | 174/51 |
| 5,679,926 | A | * | 10/1997 | Maloney et al. | 174/652 |
| 5,691,506 | A | * | 11/1997 | Miyazaki et al. | 174/652 |
| 5,929,383 | A | * | 7/1999 | Marik et al. | 174/78 |
| 6,019,615 | A | * | 2/2000 | Masuda | 439/99 |
| 6,042,396 | A | * | 3/2000 | Endo et al. | 439/98 |
| 6,053,749 | A | * | 4/2000 | Masuda et al. | 439/98 |
| 6,152,745 | A | * | 11/2000 | Matsumoto et al. | 439/98 |

(Continued)

FOREIGN PATENT DOCUMENTS

| | | | |
|---|---|---|---|
| EP | 0573126 | A2 | 12/1993 |
| EP | 1744409 | A2 | 1/2007 |

(Continued)

OTHER PUBLICATIONS

International Search Report for PCT/JP2010/058481 dated Jul. 26, 2010 [PCT/ISA/210].

*Primary Examiner* — Ross Gushi
(74) *Attorney, Agent, or Firm* — Sughrue Mion, PLLC

(57) ABSTRACT

A fixing structure includes: a shield electric wire; a shield shell having a small diameter part having a hollow tubular-shape through which the exposed part passes, and an outer periphery being covered with an end of a peeled braided part of the shield electric wire, and a main body part having a hollow shape extended from the small diameter part and through which the shield electric wire passes; a shield ring clamped to the small diameter part under a state that the end of the peeled braided part is located between the shield ring and the small diameter part; and an inner holder that is inserted into and fixed to an inner part of the main body part under a state that the shield electric wire passes through the inner holder.

4 Claims, 12 Drawing Sheets

U.S. PATENT DOCUMENTS 6,261,108 B1 * 7/2001 Kanagawa et al. ..... 439/98
6,262,374 B1 * 7/2001 Matsumoto et al. ..... 174/74 R
6,280,208 B1 * 8/2001 Masuda et al. ..... 439/98
6,524,121 B2 * 2/2003 Kanagawa ..... 439/98
6,583,352 B2 * 6/2003 Fukushima et al. ..... 174/373
6,639,146 B1 * 10/2003 Chiu ..... 174/359
6,669,511 B1 * 12/2003 Yagi et al. ..... 439/607.44
6,688,896 B2 * 2/2004 Matsumoto ..... 439/98
6,781,059 B2 * 8/2004 Mizutani ..... 174/75 C
6,793,532 B2 * 9/2004 Saito et al. ..... 439/607.41
6,815,610 B2 * 11/2004 Kuboshima et al. ..... 174/360
6,864,426 B2 * 3/2005 Miyazaki ..... 174/75 C
6,893,273 B2 * 5/2005 Sato et al. ..... 439/98
6,916,205 B1 * 7/2005 Kaneko ..... 439/607.42
6,921,292 B2 * 7/2005 Miyazaki ..... 439/564
7,041,907 B2 * 5/2006 Miyazaki ..... 174/72 A
7,094,970 B2 * 8/2006 Kihira ..... 174/74 R
7,153,146 B2 * 12/2006 Shimizu et al. ..... 439/98
7,275,960 B2 10/2007 Fukushima et al.
7,491,071 B2 * 2/2009 Hamai et al. ..... 439/98
7,534,138 B1 * 5/2009 Gump et al. ..... 439/564
7,614,910 B2 * 11/2009 Croteau et al. ..... 439/573
7,666,032 B2 * 2/2010 Aoki et al. ..... 439/607.41
7,749,025 B2 * 7/2010 Aoki et al. ..... 439/607.41
7,893,354 B2 * 2/2011 Albert et al. ..... 174/72 A
7,959,468 B2 * 6/2011 Yong et al. ..... 439/607.41
8,191,250 B2 * 6/2012 Kawase et al. ..... 29/857
2001/0055895 A1 * 12/2001 Kanagawa ..... 439/98
2002/0048994 A1 * 4/2002 Oota et al. ..... 439/607
2003/0221850 A1 * 12/2003 Mizutani ..... 174/36
2004/0106325 A1 * 6/2004 Miyazaki ..... 439/607
2004/0144557 A1 * 7/2004 Miyazaki ..... 174/72 A
2007/0021006 A1 1/2007 Kawamura et al.
2009/0093159 A1 * 4/2009 Aoki et al. ..... 439/610
2009/0098779 A1 4/2009 Kawamura
2009/0260232 A1 10/2009 Aoki et al.
2010/0000788 A1 * 1/2010 Kawase et al. ..... 174/74 R
2011/0284266 A1 * 11/2011 Deno et al. ..... 174/136
2012/0058674 A1 * 3/2012 Deno et al. ..... 439/607.52
2012/0202381 A1 * 8/2012 Deno et al. ..... 439/607.41

FOREIGN PATENT DOCUMENTS

FR 2922055 A1 4/2009
JP 11-26093 A 1/1999
JP 2007-115428 A 5/2007

* cited by examiner

FIXING STRUCTURE OF SHIELD ELECTRIC WIRE AND FIXING METHOD FOR SHIELD ELECTRIC WIRE

TECHNICAL FIELD

The present invention relates to a fixing structure for attaching a shield electric wire to a shield shell and a fixing method for the shield electric wire.

BACKGROUND ART

In the shield electric wire used for a power feeder or a wiring of various kinds of vehicles such as a hybrid vehicle, as a shield connector attached to a terminal end thereof, for instance, a shield connector disclosed in Patent Literature 1 is known.

Namely, the shield connector is used in the wiring of an electric system of the vehicle. The shield connector 100 includes, as shown in FIG. 13, a connector terminal 120 connected to a terminal end part of a shield electric wire 110 having a core wire 111, a braided part 112 and a sheath 113, a connector case 130 for protecting and accommodating the terminal end part of the shield electric wire 110, a corrugation holder 140 attached to an electric wire inserting side of the connector case 130, a corrugated tube 180 for protecting the shield wire that is connected to the electric wire inserting side of the connector case 130 through the corrugation holder 140. The corrugation holder 140 is formed with a pair of opposed half covers.

The connector case 130 of the above-described members includes an outer case 150 made of a synthetic resin and an inner case 160 similarly made of a synthetic resin and both the cases are cylindrical bodies having both ends opened. Both the outer case 150 and the inner case 160 are plated with electrically conductive metal. A lance 170 is provided to be fixed and locked to a mating connector not shown in the drawing.

According to the shield connector 100 having the above-described structure, a production cost can be reduced and a misalignment of the sheath 113 in the shield electric wire 110 or the like can be prevented, however, only an individual shield electric wire can be connected thereto. Accordingly, depending on the difference of kinds of shield electric wires for vehicles on which the shield electric wires are respectively mounted or the difference of shield processes for vehicles on which the shield electric wires are respectively mounted (namely, the difference between an individual shield process and a collective shield process or the like), the shield connector is not occasionally applicable.

Thus, as the shield connector, a shield connector disclosed in Patent Literature 2 is also proposed. Namely, this shield connector is a wire harness side shield connector 200 that is fitted and connected to an inverter unit side connector 300 as shown in FIG. 14 and FIG. 15. The wire harness side shield connector 200 includes an outer case 210 having a shield function and a housing 220 that accommodates connecting terminals respectively bonded under thermal compression and fixed to end parts of a plurality of shield electric wires 230. The outer case 210 includes a shield shell 211 that has a shield function for shielding and grounding an electromagnetic wave and accommodates the housing 220 and a shell holder 213 that is fixed to the shield shell 211 by a screw member 212 to electrically conduct braided parts 231 of the shield electric wires 230 folded to an outer peripheral side respectively to the shield shell 211.

On the other hand, the inverter unit side connector 300 includes a resin mold housing 310, an electrically conductive body 320 and an electrically conductive cover 330 attached so as to sandwich the electrically conductive body 320, and is directly connected to an inverter which is not shown in the drawing.

According to the above-described shield connector 200, the shield connector can easily and assuredly meet the difference of the kinds of the shield electric wires for each of the vehicles or the difference of the electromagnetic shield processes for each of the vehicles (namely, the difference between then individual shield process and the collective shield process or the like).

CITATION LIST

Patent Literature

Patent Literature 1: JP-A-11-26093
Patent Literature 2: JP-A-2007-115428

SUMMARY OF INVENTION

Technical Problem

In the shield connector 200 disclosed in the Patent Literature 2, a structure for fixing the terminal end parts of the braided parts 231 of the shield electric wires 230 to the shield connector 200 is complicated, and when the screw member 212 is loosen, the attached state of the shield shell 211 and the shell holder 213 that are attached integrally is put out.

The present invention is devised by considering the above-described circumstances, and it is an object of the present invention is to provide a fixing structure of a shield electric wire and a fixing method for a shield electric wire that can assuredly fix the terminal end part of a braided wire of the shield electric wire by a simple structure and that can prevent distortion or deformation of an outer configuration of the shield shell.

Solution to Problem

In order to achieve the above object, there is provided a fixing structure as described below (1) to (4).

(1) A fixing structure comprising: a shield electric wire including: a core wire; an insulating coat that covers the core wire; a braided part that covers the insulating coat; a peeled braided part that is peeled from the braided part; and a sheath that covers the braided part; a shield shell including: a small diameter part having a hollow tubular-shape through which the exposed part passes, and an outer periphery being covered with an end of the peeled braided part; and a main body part having a hollow shape extended from the small diameter part and through which the core wire and the insulating coat pass; a shield ring clamped to the small diameter part under a state that the end of the peeled braided part is located between the shield ring and the small diameter part; and an inner holder that is inserted into and fixed to an inner part of the main body part under a state that the core wire and the insulating coat pass through the inner holder.

(2) The fixing structure of (1), wherein the main body part of the shield shell has a hollow quadratic prism shape.

(3) The fixing structure of (2), wherein the main body part of the shield shell has a four wall surfaces facing the insulating coat and curved boundary parts for connecting the wall surfaces, respectively.

(4) The fixing structure of (2), wherein the main body part of the shield shell has an engaging part at least on one surface thereof, and a lance formed in an outer periphery of the inner holder is engaged with the engaging part of the main body part to fix the inner holder to the main body part of the shield shell.

According to the fixing structure having the configuration (1), even when during a clamping operation of the shield ring, a fastening force is exerted on the small diameter part of the shield shell so that the fastening force is transmitted to the main body part of the shield shell, the distortion or deformation of an outer configuration of the main body part of the shield shell can be prevented. As a result, the engaged state of the shield shell and the inner holder is not unfastened so that an assured holding force may be ensured and a space may be avoided from being formed between the shield electric wire or the inner holder and the shield shell in accordance with the deformation of the shield shell.

According to the fixing structure having the configuration (2) or the configuration (3), the main body part of the shield shell can be simply formed by a drawing press.

According to the fixing structure having the configuration (4), the inner holder can be prevented from slipping out from the shield shell. Further, when the inner holder is inserted into the shield shell, an operator can recognize that the inner holder is inserted into a prescribed position.

There is also provided a fixing method as described below (5).

(5) A fixing method comprising: allowing a shield electric wire including a core wire, an insulating coat that covers the core wire, a braided part that covers the insulating coat, a peeled braided part that is peeled from the braided part, and a sheath that covers the braided part, to pass through a shield ring and a shield shell including a small diameter part having a hollow tubular-shape through which the core wire and the insulating coat pass, and an outer periphery being covered with an end of the peeled braided part and a main body part having a hollow shape extended from the small diameter part and through which the core wire and the insulating coat pass; arranging the end of peeled part of the braided part between the shield ring and the small diameter part; clamping the shield ring to the small diameter part; and fixing an inner holder through which the core wire and the insulating coat of the shield electric wire pass to an inner part of the main body part of the shield shell.

According to the fixing method for the shield electric wire of the configuration (5), even when during a clamping operation of the shield ring, a fastening force is exerted on the small diameter part of the shield shell so that the fastening force is transmitted to the main body part of the shield shell, the distortion or deformation of an outer configuration of the main body part of the shield shell can be prevented. As a result, the engaged state of the shield shell and the inner holder is not unfastened so that an assured holding force may be ensured and a space may be avoided from being formed between the shield electric wire or the inner holder and the shield shell in accordance with the deformation of the shield shell.

ADVANTAGEOUS EFFECTS OF INVENTION

According to the present invention, when the shield ring and the small diameter part of the shield shell are integrally clamped, the main body can be effectively avoided form being distorted or deformed. As a result, an inserting part of the inner holder can be assuredly inserted without a gap between the small diameter part of the shield shell and the insulating coat of the shield electric wire. Further, an engagement margin is sufficiently ensured between the lance engaging part of the shield shell and the lance of the inner holder, so that a strong and assured connecting state can be realized.

The present invention is briefly described as mentioned above. Further, when an exemplary embodiment for carrying out the present invention which will be described below will be read by referring to the attached drawings, a detail of the present invention will be more clear.

DESCRIPTION OF EMBODIMENTS

Now, an exemplary embodiment of the present invention will be described in detail below by referring to the attached drawings.

Figure 1:
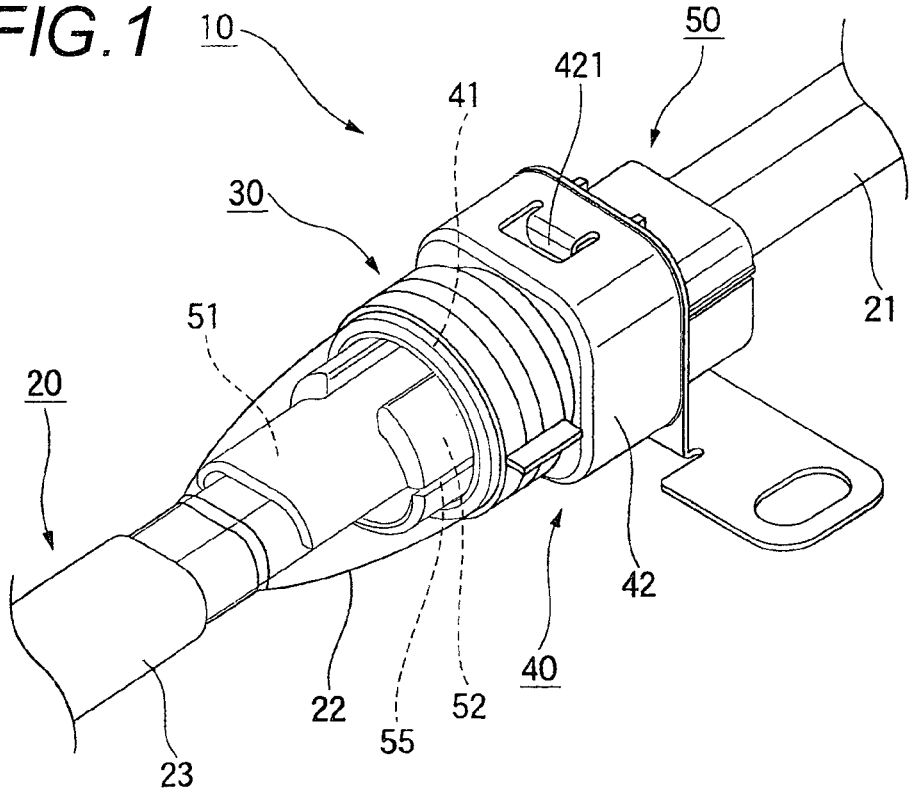
FIG. 1 is a perspective view showing a fixing structure of a shield electric wire according to an exemplary embodiment of the present invention.
Figure 2A:
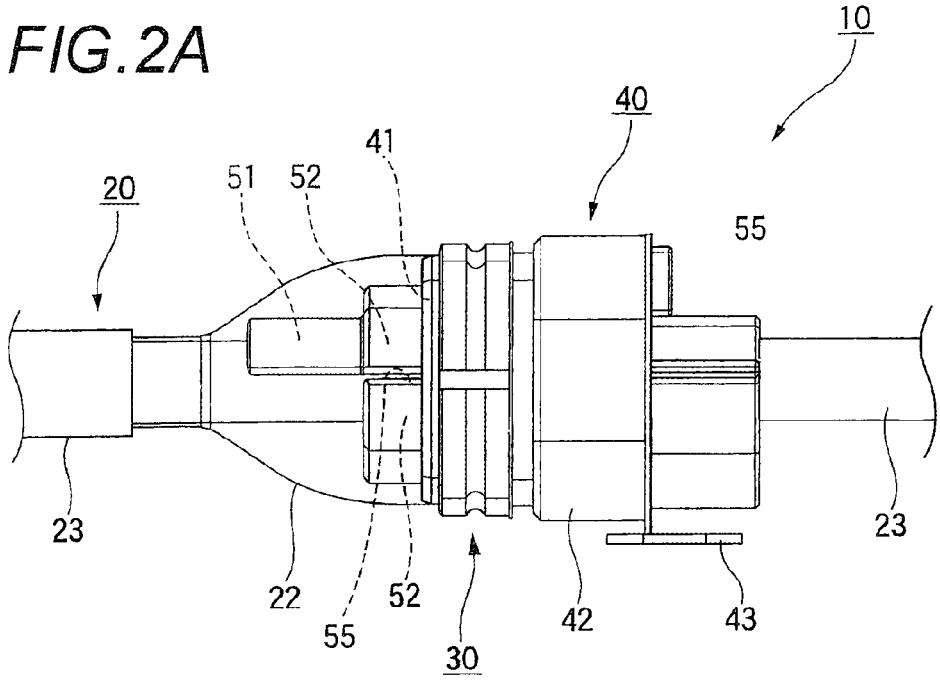
FIG. 2A is a side view showing the fixing structure of the shield electric wire in FIG. 1
Figure 2B:
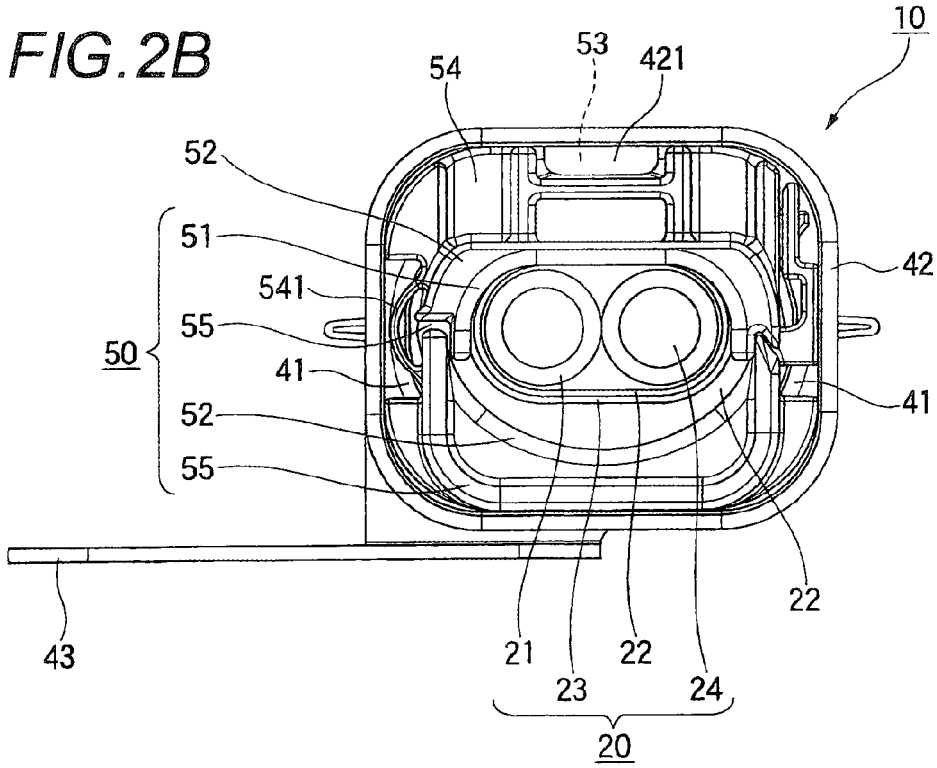
FIG. 2B is a front view thereof.
Figure 3:
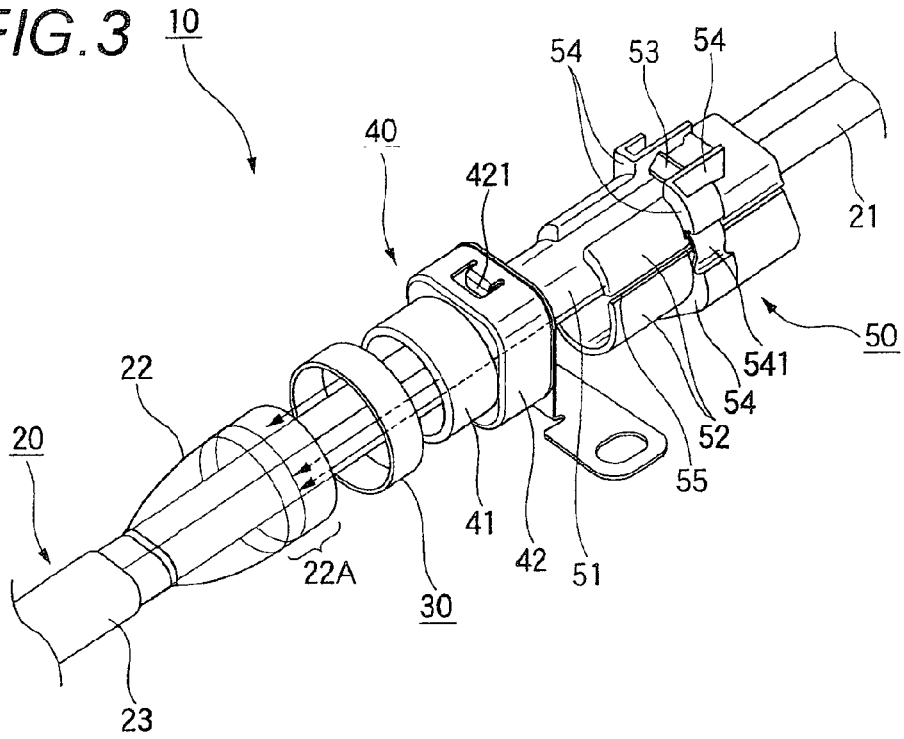
FIG. 3 is an exploded perspective view of FIG. 1.

FIGS. 1 to 3 show a fixing structure 10 of a shield electric wire according to the exemplary embodiment of the present invention. The fixing structure 10 of the shield electric wire includes a shield electric wire 20, a shield ring 30, a shield shell 40 and an inner holder 50 (In FIG. 3, the shield ring 30 is shown under a state before the shield ring is clamped).

The shield electric wire 20 includes a core wire 24 in a central part, an insulating coat 21 formed with an insulator such as an insulating resin with which an outer periphery of the core wire 24 is coated, an electrically conductive braided part 22 provided in the outer periphery of the insulating coat 21 and an insulating sheath 23 with which an outer side of the braided part 22 is coated. The shield electric wire 20 of this exemplary embodiment has a structure that core wires of two cores are shielded together. However, a shield electric wire may be used that has a structure in which core wires of a single core or three or more cores are shielded together. The braided part 22 has a folded part 22A (see FIG. 3) formed previously by folding an end part inside (or outside) by a prescribed length.

The shield ring 30 is formed with a thin metal material having a prescribed strength in a hollow cylindrical shape. The shield electric wire 20 passes through a ring shaped inner part of the shield ring 30. When the shield ring 30 is attached to the shield electric wire 20 and the shield shell 40, in the ring shaped inner part thereof, the core wire 24 and the insulating coat 21 of the shield electric wire 20, a part of the shield shell 40 (a below-described small diameter part 41), the folded part 22A of the braided part 22 of the shield electric wire 20 peeled off from the core wire 24 and the insulating coat 21 and the shield ring 30 are arranged in this order outward in the radial direction. Especially, a part of the shield shell 40 (the below-described small diameter part 41) and the folded part 22A are arranged to be laminated.

Figure 4:
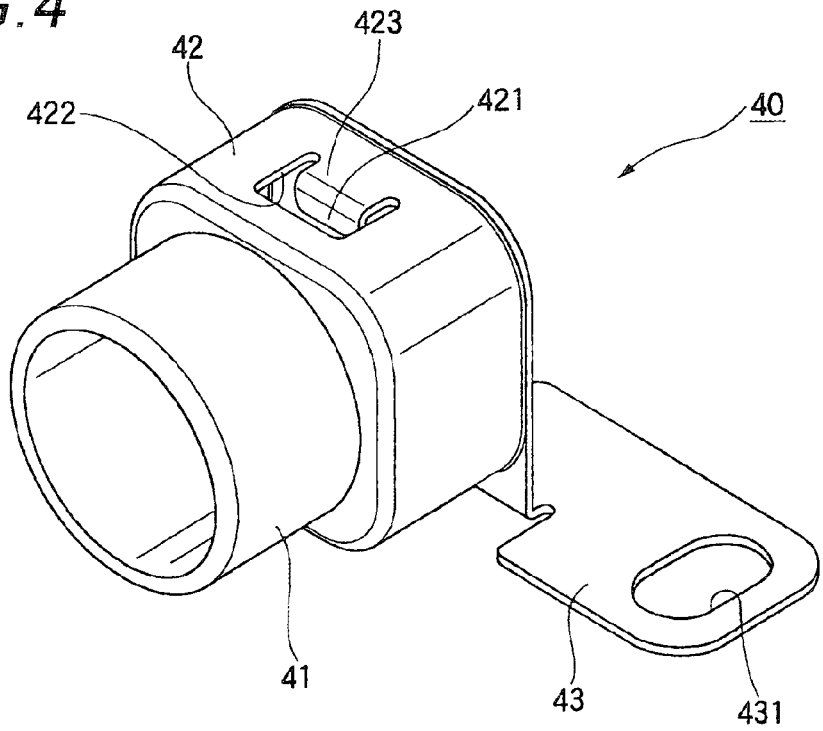
FIG. 4 is a perspective view showing a shield shell used in the fixing structure of the shield electric wire.

As shown in FIGS. 4 and 5, the shield shell 40 includes the small diameter part 41 having the hollow cylindrical shape, a main body part 42 connected to one end of the small diameter part 41 and a support piece 43 attached to the main body part 42.

The small diameter part 41 is arranged relative to the shield electric wire 20 so that the core wire 24 and the insulating coat 21 of the shield electric wire 20 passes through the hollow part thereof and the folded part 22A of the braided part 22 covers a tubular outer side surface (an outer periphery). Further, the small diameter part 41 is arranged under a state that the small diameter part 41 passes through the shield ring 30. The shield ring 30 having the ring shaped inner part in which the small diameter part 41 is located is arranged so as to cover the outer side surface of the folded part 22A of the braided part 22. The small diameter part 41 has an inside diameter larger than the outside diameter (the outside diameter in the direction of a long diameter) of the insulating coat 21 of the two cores of the shield electric wire 20 and an outside diameter smaller than the inside diameter of the shield ring 30. Further, the small diameter part 41 is passed through by a sleeve of the below-described inner holder 50.

The main body part 42 has a hollow tubular form and the inner holder 50 is accommodated therein. The main body part 42 has one side to which the small diameter part 41 is connected and the other side opened to insert the inner holder 50. The main body part 42 is formed in a hollow quadratic prism shape and includes four wall surfaces facing the insulating coat 21 of the shield electric wire 20 passing through the main body part 42. Further, boundary parts for connecting the wall surfaces respectively form round shaped curved surfaces, so that an entire part of an outer periphery of the main body part shows a seamless form. Further, the outer form of the main body part 42 is larger than the outside diameter of the small diameter part 41, so that a stepped part is formed in a connecting part of the main body part 42 and the small diameter part 41.

Further, in the main body part 42, a lance engaging part 421 is formed with which a lance 53 of the below-described inner holder 50 is engaged on one surface of the four wall surfaces. The lance engaging part 421 is formed by cutting inward the main body part 42 a tongue piece 423 facing a groove 422 formed substantially in a U shape. The above-described forms of the small diameter part 41 and the main body part 42 can be formed by a drawing press. Since the main body part is formed by the drawing press, the main body part is formed without seams. In other word, the main body can be formed under a state that a fragile part does not exist in a part thereof.

The main body 42 is not necessarily formed in a hollow quadratic prism shape, and may be formed in a cylindrical shape or in a polygonal column having three or five surfaces or more.

The support piece 43 secures the shield electric wire 20 fixed by the fixing structure of the present invention to a part (for instance, a vehicle panel) of a vehicle not shown in the drawing and a slot 431 is formed which is attached to a stud bolt protruding from the vehicle panel. The support piece 43 of the present exemplary embodiment is extended from an end part of one wall surface of the main body part 42, and is bent at 90° relative to the main body part 42 so as to be parallel to the one surface having the lance engaging part 421.

The inner holder 50 is inserted into and fixed to an inner part of the above-described main body part 42 of the shield shell 40 from an opposite side to a side in which the small diameter part 41 is provided under a state that the inner holder 50 is passed through by the core wire 24 and the insulating coat 21 of the shield electric wire 20. The inner holder 50 is formed with a semi-cylindrical part with a substantially U shaped form in section divided by a slit 55 (see FIGS. 1 to 3) in one side, and divided parts are integrally connected together by a connecting part 541 (see FIG. 3) in a base end part side. The inner holder 50 includes, as shown in FIGS. 2A and 2B, inserting parts 52 facing outer peripheral surfaces of an upper part and a lower part of the insulating coat 21, a half divided part 51 extended from an end of the inserting part 52 located in an upper side and attached in close contact with the outer peripheral surface of the upper part of the insulating coat 21, the lance 53 formed in a cantilever support state in the upper side of the inserting part 52 and engaged with the lance engaging part 421 of the shield shell 40 and cut-off wall parts 54 respectively formed in upper sides and lower sides of the inserting parts 52 to prevent the entry of water drops from the upper part of the insulating coat 21. The inner holder 50 is fixed to the shield shell 40 under a state that the core wire 24 and the insulating coat 21 of the shield electric wire 20 are inserted into an electric wire holding hole formed in a sleeve formed by the half divided part 51 and the inserting parts 52 and the sleeve passes through the small diameter part 41 of the shield shell 40. At this time, since the cut-off walls 54 located in the outer periphery of the inner holder 50 are located more outside than the outside diameter of the sleeve formed by the inserting part 52, stepped parts are formed between the cut-off walls 54 and the inserting parts 52. Thus, the stepped parts abut on the stepped part in the connecting part of the main body part 42 and the small diameter part 41 of the shield shell 40 to regulate the insertion of the inner holder 50 into the shield shell 40.

Now, operational effects of the fixing structure of the shield electric wire of the present invention will be described.

Figure 5A:
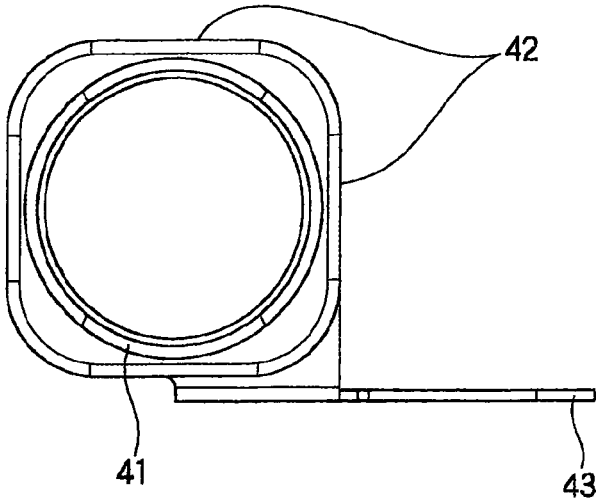
FIG. 5A is a front view of the shield shell shown in FIG. 4.
Figure 5B:
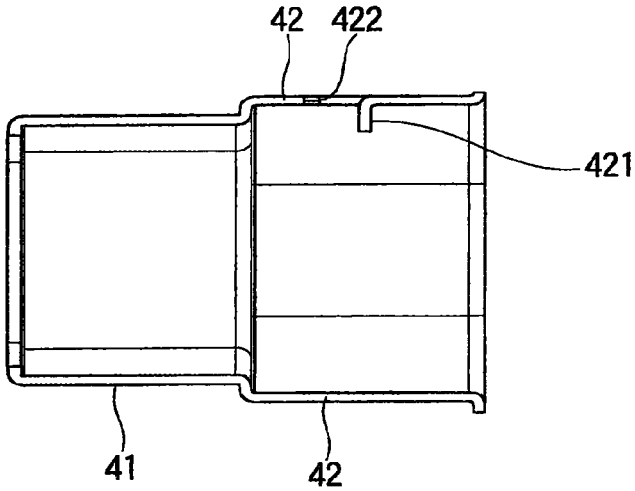
FIG. 5B is a sectional view thereof.
Figure 5C:
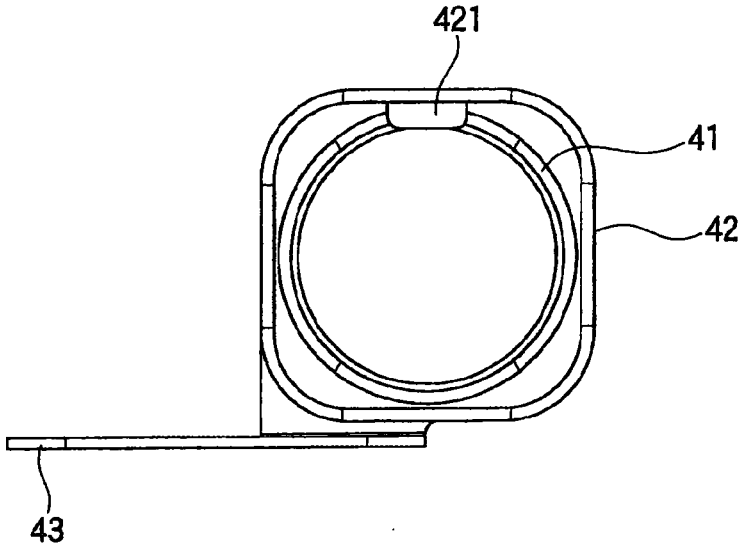
FIG. 5C is a front view showing the shield shell seen from an end face of an opposite side.

According to the fixing structure 10 of the shield electric wire of the present exemplary embodiment, as shown in FIGS. 5A to 5C, the main body part 42 of the shield shell 40 (a substantially cylindrical part) is formed by the drawing press, so that the main body part 42 is formed substantially in a box shape surrounded by an outer peripheral surface including four surfaces. In other words, since the main body part 42 has the outer peripheral surface with a four-surface structure having no seams over an entire periphery, not only the tensile strength is increased, but also the structure of the main body does not have a partial unevenness in strength and has a uniform strength over the entire periphery.

Accordingly, when the shield ring 30 is clamped to the small diameter part 41 extending integrally with the main body part 42 and pressed to the braided part 22 of the shield electric wire 20, even if a physical tension due to the clamping operation is transmitted to the main body part 42 so that the main body part 42 is apt to be pulled toward the small diameter part 41, the main body part 42 whose strength is increased can meet the tensile stress during the clamping process. Thus, the main body part 42 can be prevented from being pulled toward the small diameter part 41 and deformed.

Figure 6A:
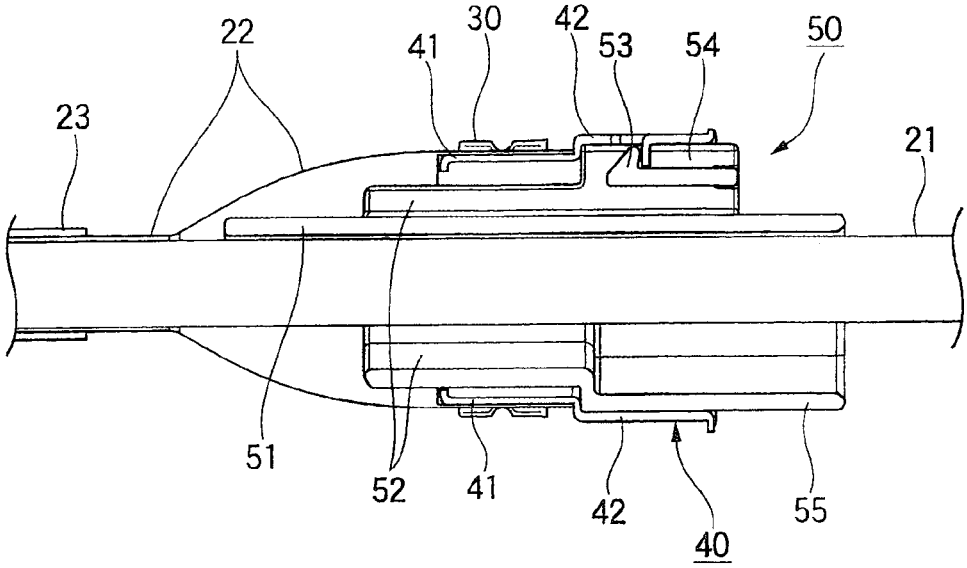
FIG. 6A is a sectional view showing the fixing structure of the shield electric wire shown in FIG. 1
Figure 6B:
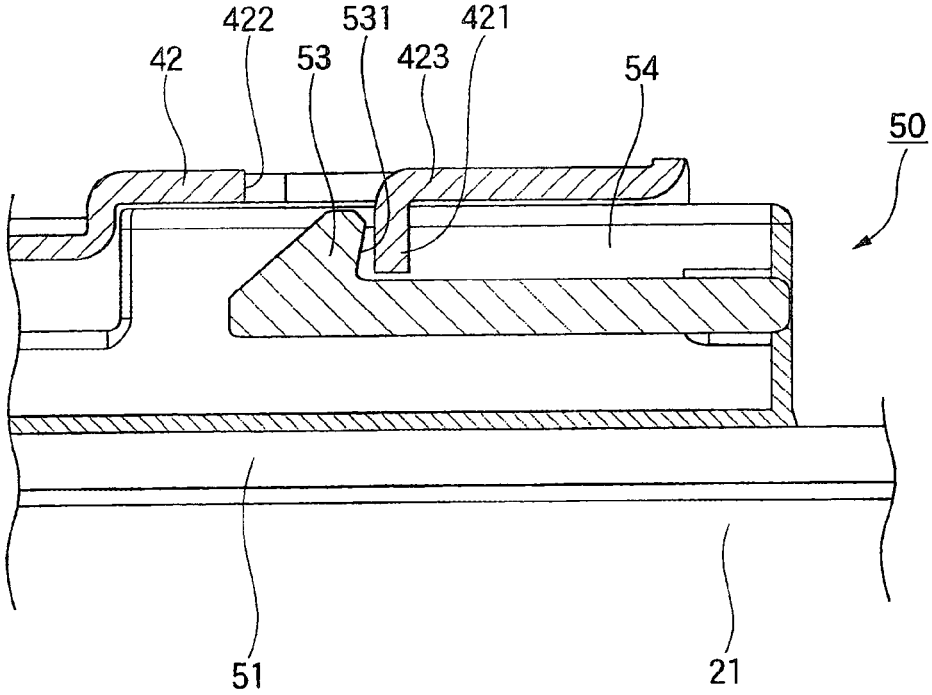
FIG. 6B is an enlarged view of main parts thereof.

Especially, one surface (an upper surface in FIG. 6A) of the main body part 42 can hold a surface state parallel to the axial direction of the main body part 42 (the shield electric wire 20). Namely, as shown in FIG. 6B, the tongue piece 423 having the lance engaging part 421 of the main body part of the shield shell 40 is not pulled to be inclined relative to the axial direction of the main body part 42 (the shield electric wire 20). Accordingly, an engagement margin between the lance engaging part 421 of the main body part of the shield shell 40 and a pawl part 531 of the lance 53 of the inner holder 50 can be sufficiently ensured to realize a strong and assured connected state.

Figure 7:
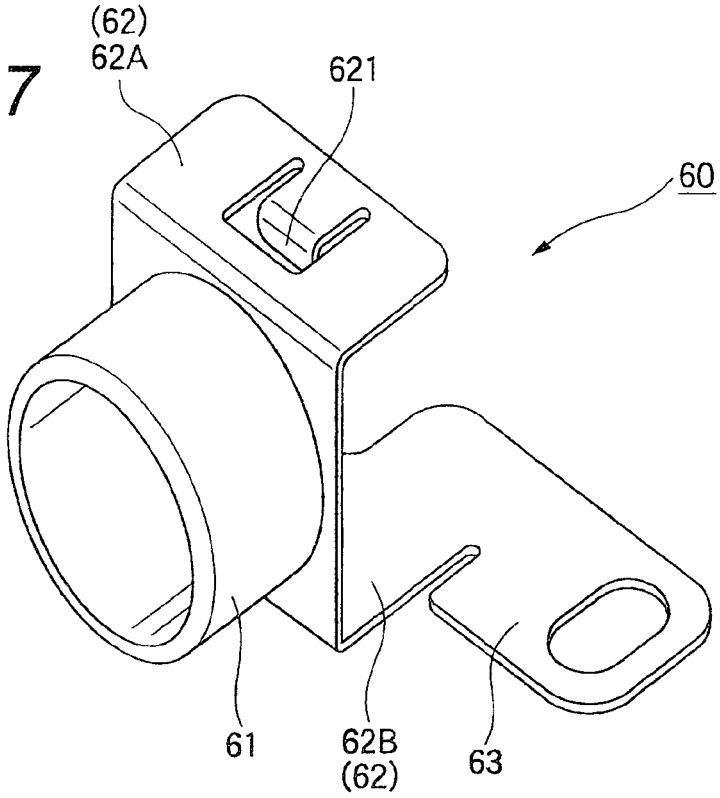
FIG. 7 is a perspective view showing a shield shell used in a fixing structure of a shield electric wire of a comparative example.
Figure 8A:
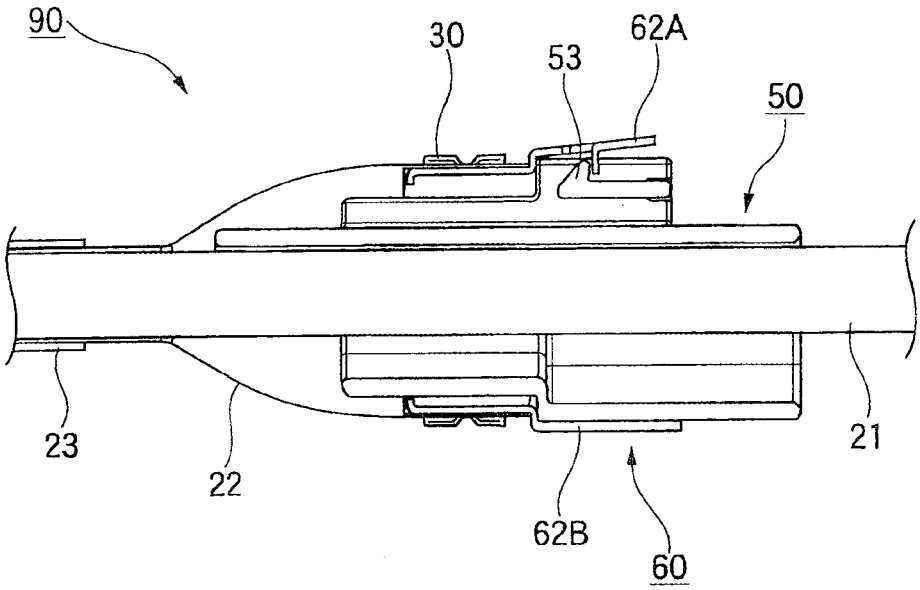
FIG. 8A is an explanatory view showing the fixing structure of the shield electric wire using the shield shell shown in FIG. 7

A fixing structure 90 shown in FIG. 8A may be considered. In the fixing structure 90, a shield shell 60 of FIG. 7 is used instead of the shield shell 40 as described above.

Figure 8B:
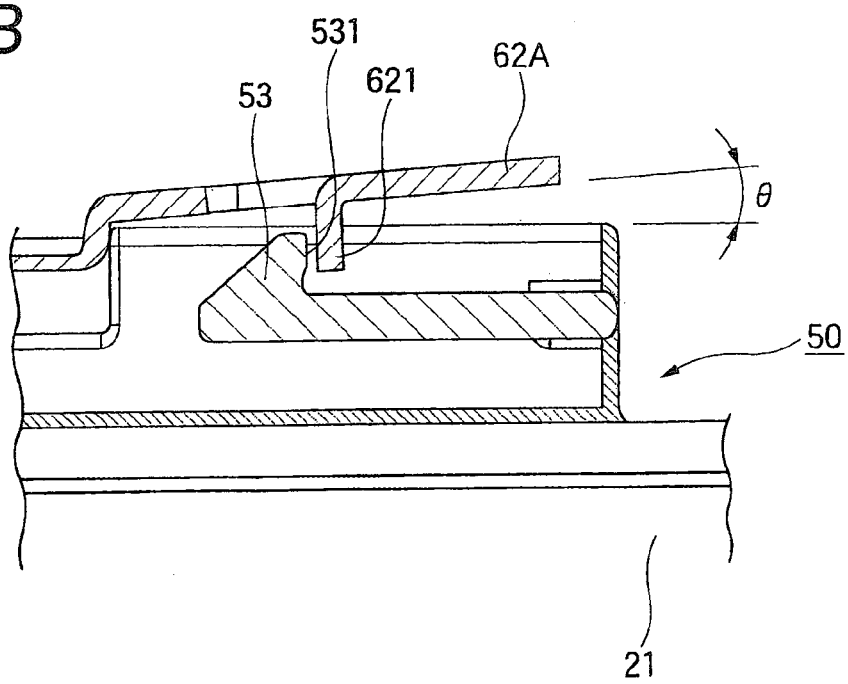
FIG. 8B is a sectional view of main parts thereof.

In the case of the fixing structure 90 of the shield electric wire shown in FIG. 8A, which uses the shield shell 60 having a main body part 62 connected to a small diameter part 61 and bent substantially in a U shape in section as shown in FIG. 7, the main body part 62 includes only two upper and lower surfaces (62A, 62B). That is, right and left surfaces are not included as compared with the shield shell 40 of FIG. 4. Since the main body part 62 of this form is lower in its anti-tensile strength than the main body part 42 of the shield shell 40 of FIG. 4, when a physical tensile stress is applied to the main body part 62 during a clamping operation, the main body part is pulled toward the small diameter part 61 (leftward in FIG. 8A), so that the form of the main body part may be changed. As a result, there is a fear that an inner holder 50 may be more hardly assuredly fitted to the shield shell 60 than in the fixing structure 10 of the shield electric wire of the present invention. Further, in the fixing structure 90 whose form is changed, as shown in FIG. 8B, an inconvenience occurs that an upper surface 62A of the small diameter part 61 side is pulled so that an opening side is greatly opened, and an engaging pawl 621 of a lance engaging part is inclined at an angle θ so as to be lower toward the small diameter 61 side so that an engagement margin to a pawl part 531 of a lance 53 of the inner holder 50 is reduced to make an engaged state unstable. Therefore, there is a fear that the inner holder 50 may slip out from the shield shell 60. However, since the shield shell 60 in FIG. 7 has a form in which the right and left surfaces are omitted as compared with the structure of the shield shell 40, it is possible to reduce the weight and material cost. Thus, in such a case where the fixing structure does not require the strict design to have a high anti-tensile strength, the shield shell 60 can be applied to form the fixing structure 90.

Now, a fixing method for the shield electric wire to the shield shell according to the present invention will be described below.

Figure 9:
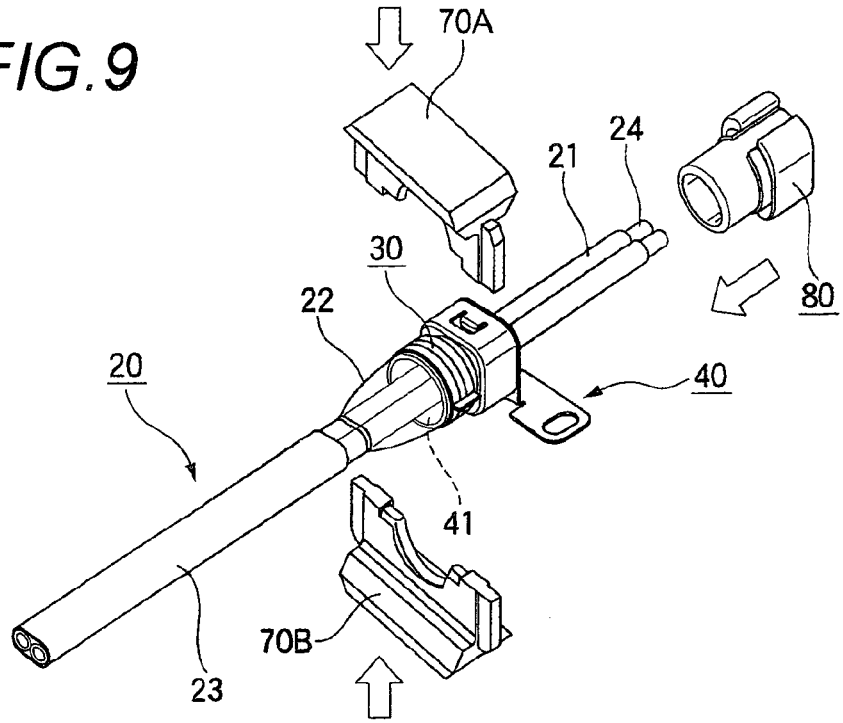
FIG. 9 is a perspective view showing one process of a fixing method for the shield electric wire shown in FIG. 1.

(1) Initially, as shown in FIG. 9, the sheath 23 is cut by a prescribed length from one end of the shield electric wire 20 to expose the braided part 22. Further, the braided part 22 is peeled off from the insulating coat 21 that covers the core wire 24. One end side of the peeled braided part 22 is expanded in a tapered form as shown in FIGS. 1 and 2 and an area of a prescribed length from the terminal end of the braided part 22 is folded outside (or inside) to form a folded part 22A.

(2) Then, the shield electric wire 20 passing the process (1) is inserted into the shield ring 30, the small diameter part 41 and the main body part 42 of the shield shell 40. The order of the process (1) and the process (2) may be reverse.

(3) Then, in the folded part 22A of the braided part 22 of the shield electric wire 20, the shield ring 30 is arranged so as to cover the outer periphery of the folded part 22A as shown in FIG. 3. The shield ring 30 and the shield shell 40 are moved relatively to the shield electric wire 20 so that the small diameter part 41 of the shield shell 40 is located in the inner part of the folded part 22A. Thus, the core wire 24 of the shield electric wire 20, the insulating coat 21, the small diameter part 41 of the shield shell 40, the folded part 22A of the braided part 22 of the shield electric wire 20 and the shield ring 30 are laminated in this order from an inner side to an outer side.

Figure 10:
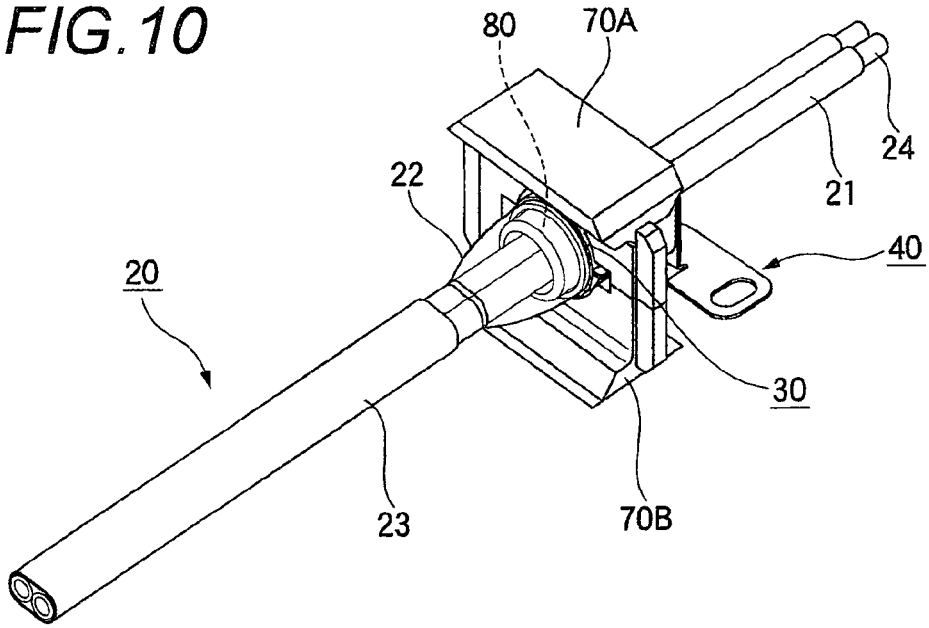
FIG. 10 is a perspective view showing one process of the fixing method for the shield electric wire shown in FIG. 1.

(4) Then, in a part (a clamping target part) in which the small diameter part 41 of the shield shell 40, the folded part 22A of the braided part 22 of the shield electric wire 20 and the shield ring 30 are laminated, clamping dies 70A and 70B are set so as to hold the clamping target part from upper and lower parts as shown in FIG. 10.

(5) Subsequently, a core 80 is internally inserted so that the small diameter part 41 of the shield shell 40 forming an innermost layer of the clamping target part is internally inserted. Then, as shown in FIG. 10, the clamping dies 70A and 70B are fastened to clamp the clamping target part. The core 80 has a hollow tubular form whose outside diameter substantially corresponds to the inside diameter of the small diameter part 41 of the shield shell 40 and the insulating coat 21 of the shield electric wire passes through the inner part of the core 80. The core 80 has a high rigidity. Thus, when the clamping dies 70A and 70B are fastened to clamp the shield ring 30 to the small diameter part 41, the core 80 pushes back the small diameter part 41 from an inner side to an external force. The deformation of the small diameter part 41 due to the clamping process of the shield ring 30 can be prevented.

Figure 11:
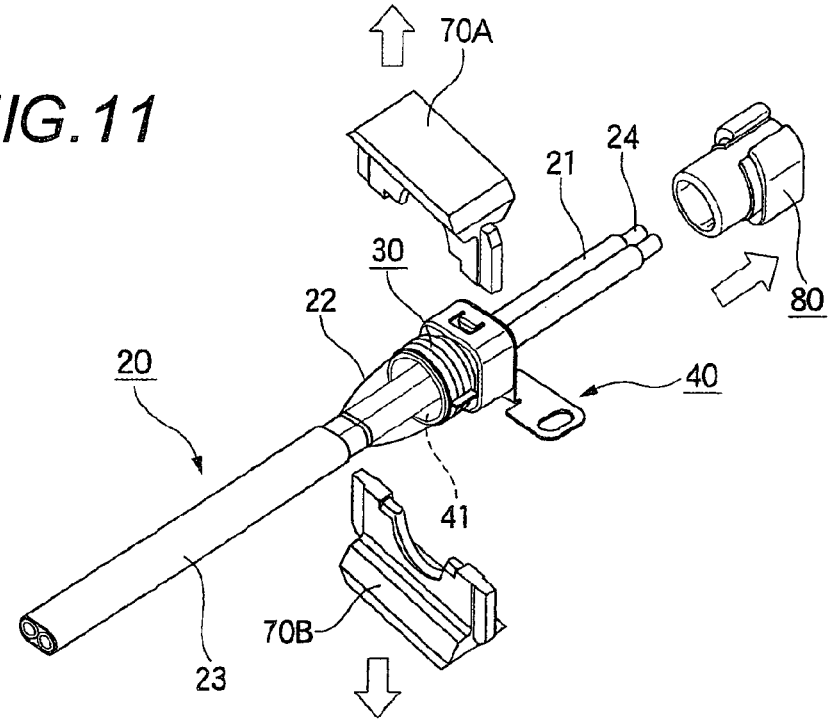
FIG. 11 is a perspective view showing one process of a fixing method for the shield electric wire shown in FIG. 1.

(6) After the above-described clamping operation is completed, as shown in FIG. 11, the clamping dies 70A and 70B are removed and the core 80 is separated.

Figure 12:
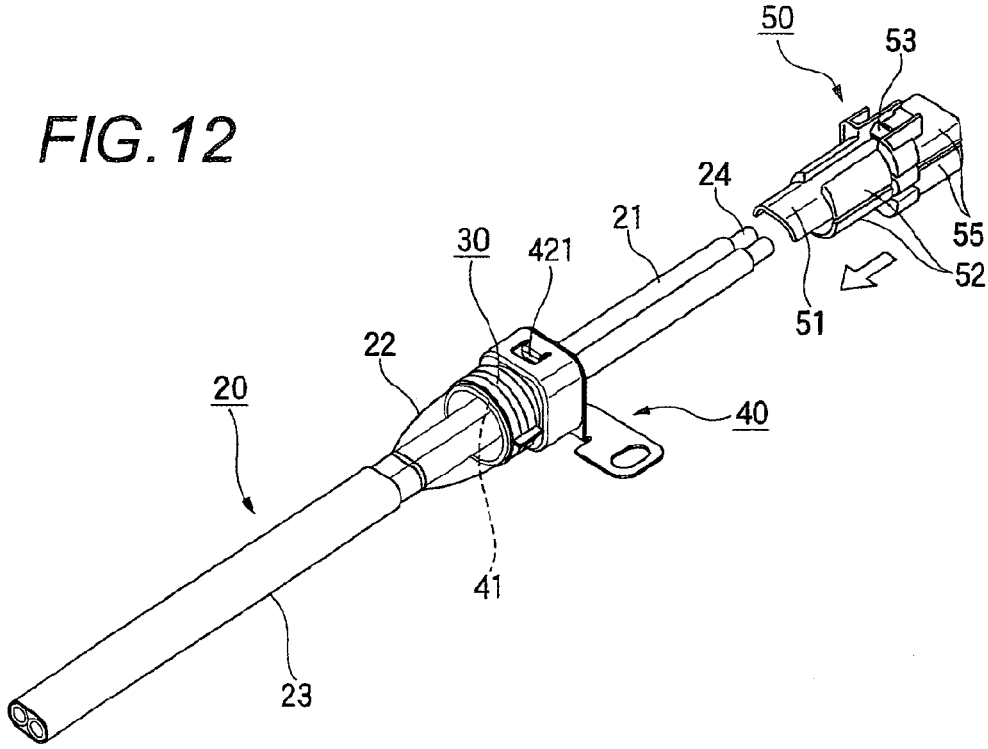
FIG. 12 is a perspective view showing one process of the fixing method for the shield electric wire shown in FIG. 1.
Figure 13:
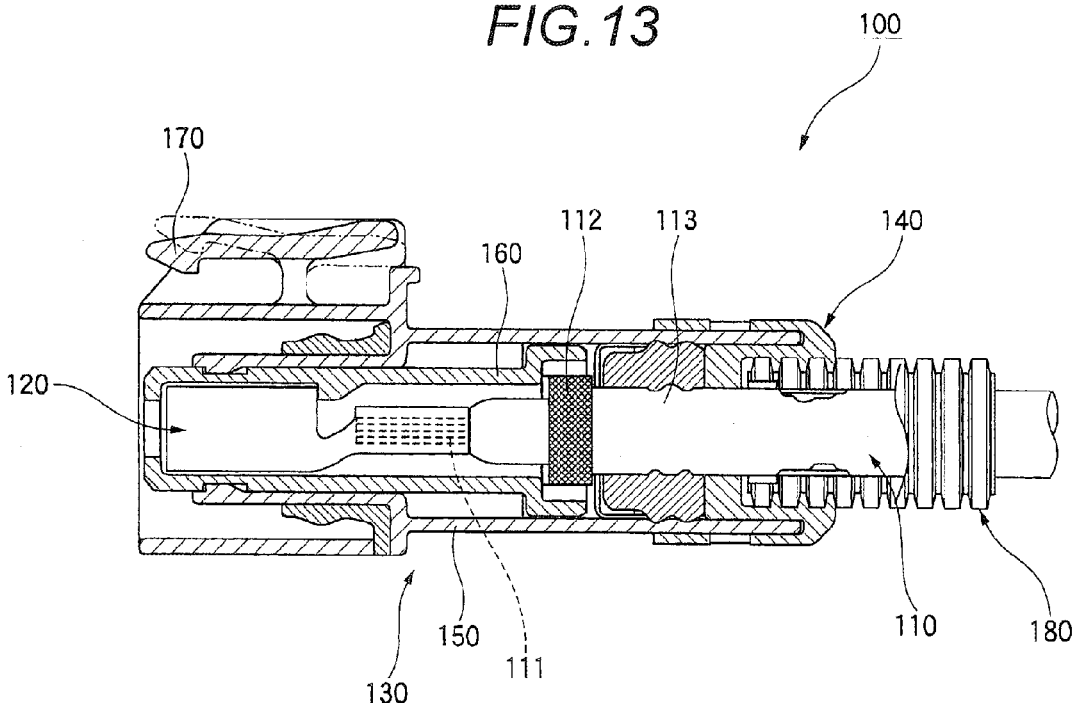
FIG. 13 is a sectional view showing a usual shield connector.
Figure 14:
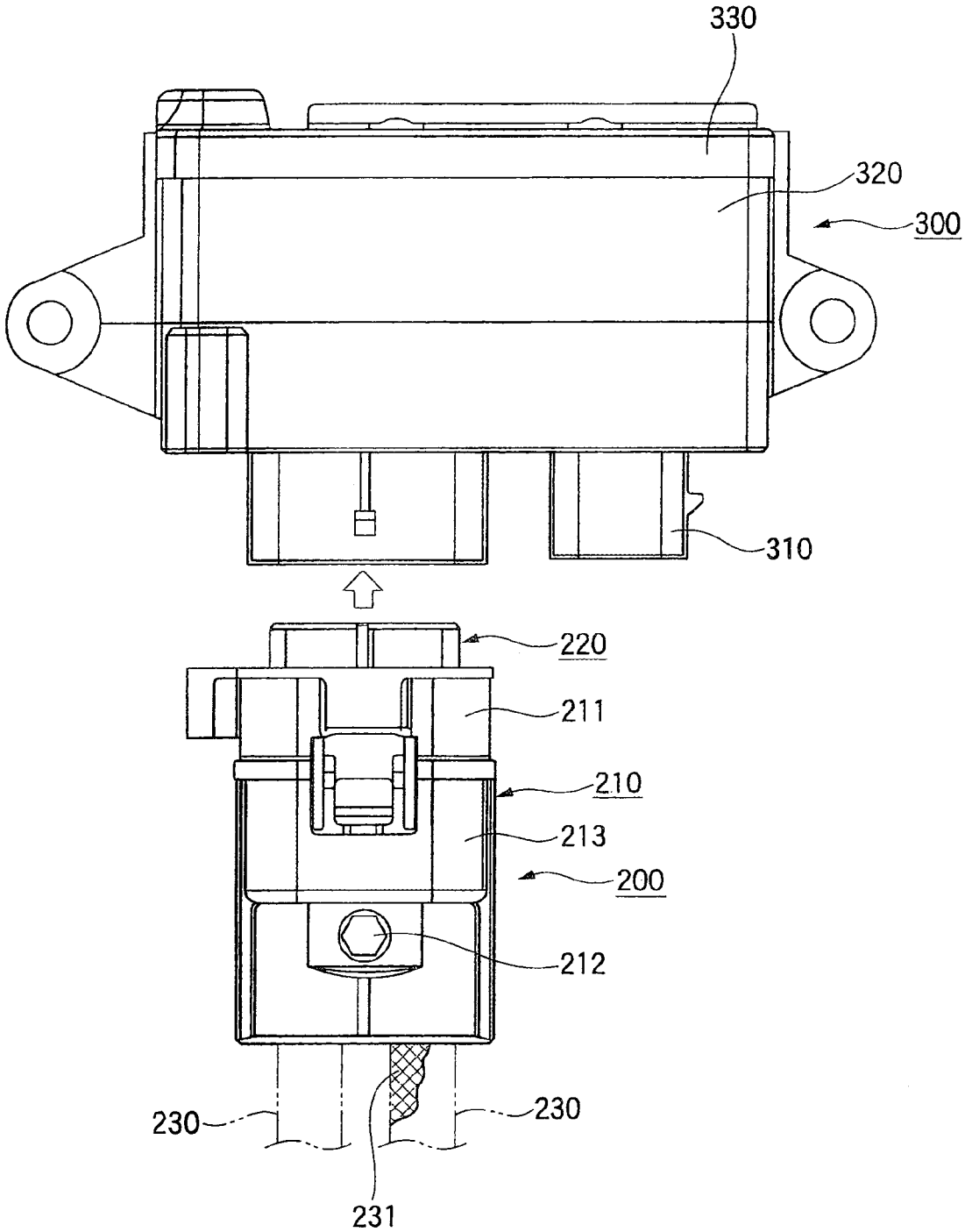
FIG. 14 is a sectional view showing another usual shield connector.
Figure 15:
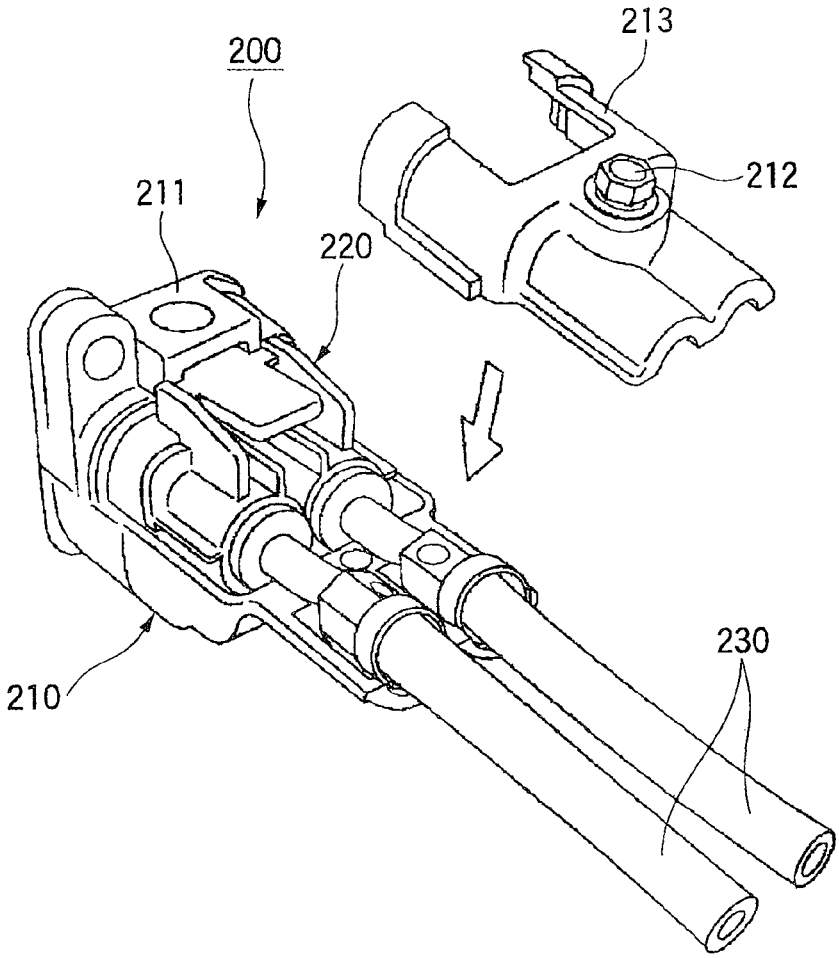
FIG. 15 is an exploded perspective view showing a wire harness side shield connector forming a part of the shield connector shown in FIG. 14.

(7) Finally, as shown in FIG. 12, the half divided part 51 of the inner holder 50 is attached to the outer surface of a half circumference of the insulating coat 21 of the shield electric wire 20 and the half divided part 51 is moved along the insulating coat 21 to insert the inner holder 50 to a part where the end of the half divided part 51 passes the small diameter part 41 of the shield shell 40 and reaches a prescribed position, namely, the lance 53 is engaged with the lance engaging part 421 of the shield shell 40. At this time, the half divided part 51 and the insulating coat 21 exposed from the inner holder 50 in a lower side of the half divided part 51 may be wound in the circumferential direction by a tape to fix the insulating coat 21 and the core wire 24 to the inner holder and the inner holder 50 may be inserted under the fixed state.

According to the above described fixing structure of the shield electric wire and the fixing method for the shield electric wire of the present invention, even when during the clamping operation of the shield ring 30, a fastening force is exerted on the small diameter part 41 of the shield shell 40 so that the fastening force is transmitted to the main body part 42 of the shield shell, the distortion or deformation of the outer configuration of the main body part 42 of the shield shell 40 can be prevented. As a result, the engaged state of the shield shell 40 and the inner holder 50 is not unfastened so that an assured holding force may be ensured and a space may be avoided from being formed between the shield electric wire 20 or the inner holder 50 and the shield shell in accordance with the deformation of the shield shell 40.

The invention claimed is:

1. A fixing structure comprising:

a shield electric wire including: a core wire; an insulating coat that covers the core wire; a braided part that covers the insulating coat; a peeled braided part that is peeled from the braided part to define an exposed part at which the insulating coating is exposed; and a sheath that covers the braided part;

a shield shell including:

a small diameter part having a hollow tubular-shape through which the exposed part passes, and an outer periphery being covered with an end of the peeled braided part;

a main body part having a hollow prism shape extended from one end of the small diameter part and through which the core wire and the insulating coat pass; and a lance engaging part formed by cutting at least on one surface of the main body part;

a shield ring clamped to the small diameter part under a state that the end of the peeled braided part is located between the shield ring and the small diameter part; and an inner holder that includes a lance formed in an outer periphery of the inner holder to be engaged with the lance engaging part, the inner holder being inserted into and fixed to an inner part of the main body part by engagement of the lance with the lance engaging part of the shield shell under a state that the core wire and the insulating coat pass through the inner holder.

2. The fixing structure according to claim 1, wherein the main body part of the shield shell has a hollow quadratic prism shape.

3. The fixing structure according to claim 2, wherein the main body part of the shield shell has four wall surfaces facing the insulating coat and curved boundary parts for connecting the wall surfaces, respectively.

4. A fixing method comprising:

allowing a shield electric wire including a core wire, an insulating coat that covers the core wire, a braided part that covers the insulating coat, a peeled braided part that is peeled from the braided part, and a sheath that covers the braided part, to pass through a shield ring and a shield shell including a small diameter part having a hollow tubular-shape through which the core wire and the insulating coat pass, an outer periphery being covered with an end of the peeled braided part and a main body part having a hollow prism shape extended from one end of the small diameter part and through which the core wire and the insulating coat pass; and a lance engaging part formed by cutting at least on one surface of the main body part;

arranging the end of peeled part of the braided part between the shield ring and the small diameter part;

clamping the shield ring to the small diameter part; and fixing an inner holder through which the core wire and the insulating coat of the shield electric wire pass to an inner part of the main body part of the shield shell by engaging a lance formed in an outer periphery of the inner holder with the lance engagement part of the shield shell.

* * * * *